US006695365B2

(12) United States Patent
Chong et al.

(10) Patent No.: US 6,695,365 B2
(45) Date of Patent: Feb. 24, 2004

(54) REVERSIBLE LEVER DETENT SPRING MECHANISM

(75) Inventors: Gerald B. Chong, Rowland Heights, CA (US); Michael Winardi, Fullerton, CA (US)

(73) Assignee: Newfrey LLC, Newark, DE (US)

( * ) Notice: Subject to any disclaimer, the term of this patent is extended or adjusted under 35 U.S.C. 154(b) by 0 days.

(21) Appl. No.: 10/116,253

(22) Filed: Apr. 4, 2002

(65) Prior Publication Data

US 2003/0189342 A1 Oct. 9, 2003

(51) Int. Cl.[7] ..... E05B 3/00

(52) U.S. Cl. ..... 292/348; 292/347; 292/353; 292/DIG. 53; 292/DIG. 61

(58) Field of Search ..... 292/348, 353, 292/347, DIG. 53, DIG. 61

(56) References Cited

U.S. PATENT DOCUMENTS

| | | | | | |
|---|---|---|---|---|---|
| 516,670 | A | | 3/1894 | Weatherwax | |
| 529,792 | A | * | 11/1894 | Hodgson | 292/355 |
| 768,952 | A | * | 8/1904 | Roberts | 292/353 |
| 826,187 | A | | 7/1906 | McSpadden et al. | |
| 1,085,543 | A | * | 1/1914 | Collins | 292/353 |
| 1,488,014 | A | * | 3/1924 | McDonald | 292/353 |
| 1,621,174 | A | | 3/1927 | Schlage | |
| 1,951,188 | A | * | 3/1934 | Flaherty | 403/357 |
| 2,111,254 | A | | 3/1938 | Tong | |
| 2,156,486 | A | | 5/1939 | Wertz | |
| 2,252,855 | A | * | 8/1941 | Lasch | 292/353 |
| 2,369,494 | A | * | 2/1945 | Schlage | 292/352 |
| 2,660,466 | A | * | 11/1953 | Cerf | 292/352 |
| 3,019,045 | A | * | 1/1962 | Jaggi | 292/353 |
| 3,130,990 | A | * | 4/1964 | Leitmann | 403/357 |
| 3,177,024 | A | | 4/1965 | Krook et al. | |
| 3,427,061 | A | * | 2/1969 | McMeen et al. | 292/353 |
| 3,896,644 | A | | 7/1975 | Nagy et al. | |
| 4,342,478 | A | * | 8/1982 | Foshee | 292/353 |
| 4,784,418 | A | * | 11/1988 | Pearson et al. | 292/348 |
| 5,688,005 | A | * | 11/1997 | Ellis | 292/348 |
| 2002/0105195 | A1 | * | 8/2002 | Adelmayer | |

FOREIGN PATENT DOCUMENTS

| | | |
|---|---|---|
| DE | 1040932 | * 10/1958 |
| DE | 1119714 | * 12/1961 |
| GB | 795479 | * 5/1958 |

* cited by examiner

*Primary Examiner*—Robert J. Sandy
*Assistant Examiner*—Carlos Lugo
(74) *Attorney, Agent, or Firm*—Richard J. Veltman; John D. Del Ponti

(57) ABSTRACT

A spring detent mechanism for a reversible lever includes a cantilevered lever catch rigidly attached to the sleeve and a C-shaped clip disposed in a groove in the sleeve. The lever catch includes a button for engaging the lever and the C-shaped clip is disposed adjacent the button to prevent longitudinal movement of the lever unless the button is depressed.

4 Claims, 2 Drawing Sheets

REVERSIBLE LEVER DETENT SPRING MECHANISM

The present invention relates to locksets and particularly to leversets. More particularly, the invention relates to reversible levers using a spring detent mechanism.

BACKGROUND OF THE INVENTION

Lever handles typically come in right-handed and left-handed versions to accommodate right- and left-handed door installations, respectively. As a result, manufacturers and vendors must keep an inventory of both handed levers to meet consumer demand. Reversible levers are available, but they are typically symmetrical about the longitudinal axis of the lever handle. Unfortunately, retaining symmetry severely limits the design options available. Accordingly, reversible non-symmetric levers would be welcome by manufacturers and vendors alike. The problem arises in designing a mechanism for attaching the non-symmetric lever to the lockset chassis.

SUMMARY OF THE INVENTION

A spring detent mechanism for a reversible lever comprises resilient means, rigidly attached to the lever sleeve, for releasably locking the lever to the sleeve, and clip means, coupled to the sleeve, for preventing the resilient means from collapsing in a direction parallel to the longitudinal axis of the sleeve. The resilient means includes a band having a first button and a second button, with the first button engaging the sleeve and the second button engaging the lever. The clip means includes a C-shaped clip.

In a preferred embodiment of the invention, a spring detent mechanism comprises a first member and a second member. The first member has a first end rigidly attached to the sleeve and a second end disposed for movement transverse to a longitudinal axis of the sleeve. The second member is coupled to the sleeve and is disposed in a groove transverse to the longitudinal axis.

According to one aspect of the invention, the first member is a cantilevered lever catch rigidly attached to the sleeve and the second member is a C-shaped clip disposed in a groove in the sleeve and adjacent the catch. The lever catch includes a button and the C-shaped clip is disposed adjacent the button.

Other features and advantages will become apparent from the following description when viewed in accordance with the accompanying drawings and appended claims.

BRIEF DESCRIPTION OF THE INVENTION

DETAILED DESCRIPTION OF THE DRAWINGS

Figure 1:
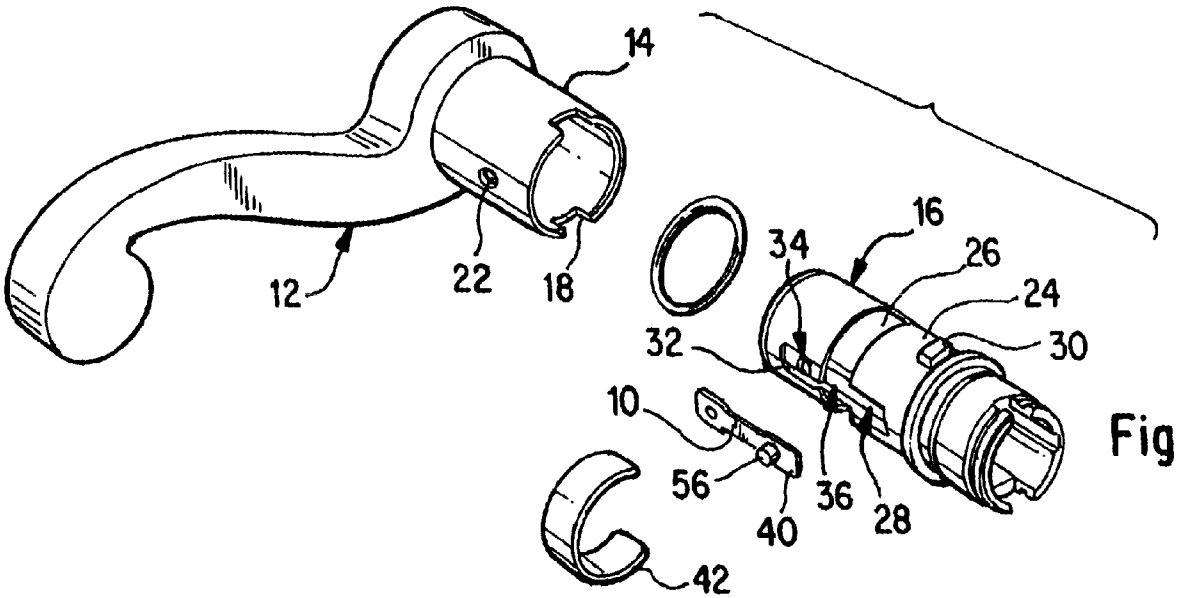
FIG. 1 is an exploded view of a lever assembly with a detent spring mechanism according to the present invention.

A detent spring mechanism 10 for use on a reversible lever is illustrated in FIG. 1. The reversible lever includes a lever handle 12 with a shank 14 and a lever sleeve 16 coupled to a conventional lockset chassis (not shown). The shank 14 includes a pair of indexing notches 18 and a detent-receiving aperture 22.

The lever sleeve 16 includes a tubular sidewall 24 sized to be received in the shank 14 of a lever handle 12. The sidewall 24 includes an annular groove 26, a longitudinally extending slot 28, and a pair of indexing bosses 30. The slot 28 includes a recessed shoulder portion 32 with an aperture 34 disposed in the center thereof. The remainder of the slot 28 includes a rectangular opening 36 through the sidewall 24.

Figure 6:
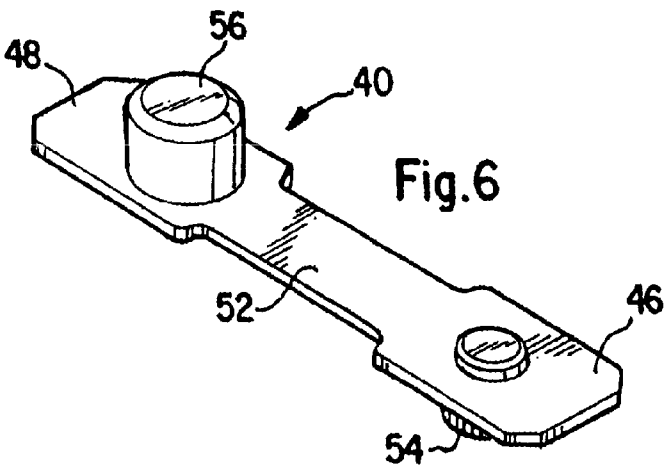
FIG. 6 is a perspective view of a flat detent for use with the detent spring mechanism.
Figure 7:
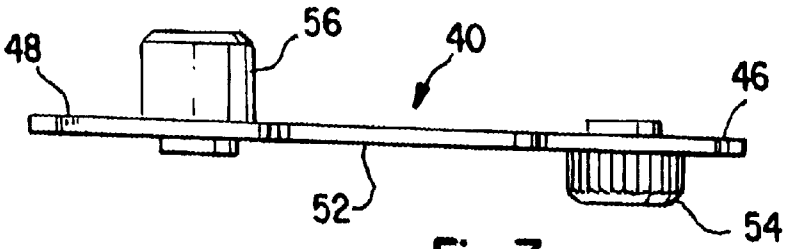
FIG. 7 is a side view of the flat detent of FIG. 6.
Figure 2:
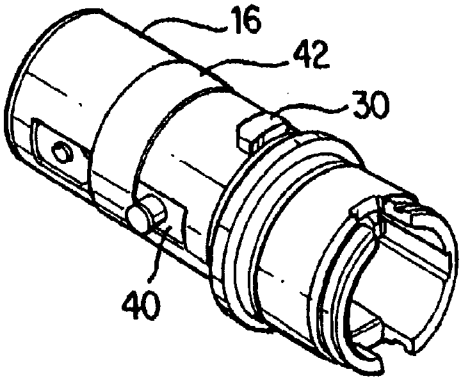
FIG. 2 is a perspective view of the detent spring mechanism of FIG. 1 assembled with the sleeve of FIG. 1.
Figure 3:
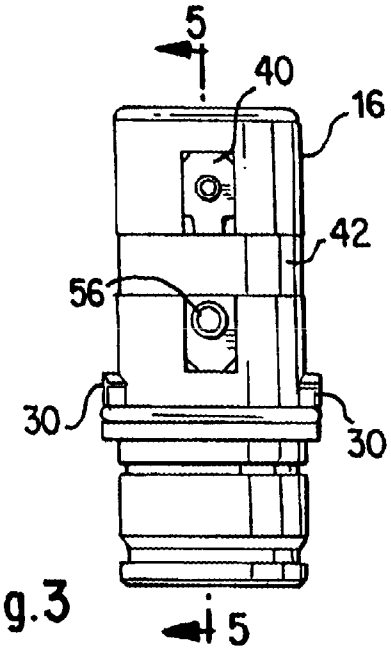
FIG. 3 is a front view of the sleeve showing the detent spring mechanism.
Figure 5:
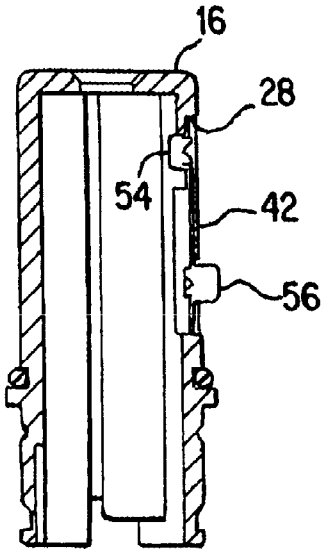
FIG. 5 is a section view taken along line 5—5 in FIG. 3.
Figure 4:
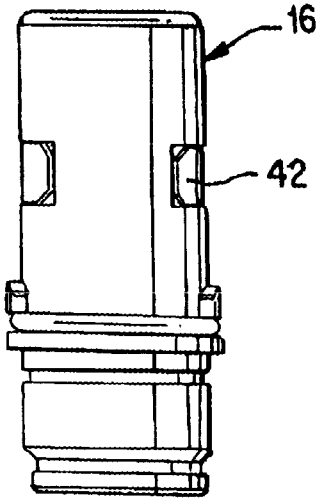
FIG. 4 is a rear view of the sleeve showing the detent spring mechanism.

As illustrated in FIGS. 6–7, the detent spring mechanism 10 includes a flat band 40 and a C-shaped clip 42. The flat band 40 includes a first end 46, a second end 48, and an intermediate portion 52 disposed between the ends 46, 48. A knurled button 54 projects downwardly from the first end 46 and a smooth button 56 projects upwardly from the second end 48.

When assembled, as illustrated in FIGS. 2–5, the band 40 is disposed in the slot 28. The knurled button 54 is configured for a press fit into the aperture 34, with the first end 46 abutting the shoulder portion 32. The second end 48 extends into the slot 28 in a cantilever fashion, with the smooth button 56 providing a lever catch. The C-shaped clip 42 is installed in the annular groove 26 so as to be generally flush with the outer surface of the sleeve 16. The shank 14 of the lever handle 12 slides over the sleeve 16 so the indexing notches 18 engage the indexing bosses 30 and the button-receiving aperture 22 engages the smooth button 56, thereby aligning the lever handle 12 and locking it to the sleeve.

The above-described embodiments, of course, are not to be construed as limiting the breadth of the present invention. Modifications and other alternative constructions will be apparent which are within the spirit and scope of the invention as defined in the appended claims.

What is claimed is:

1. A spring detent mechanism for a reversible lever the lever being coupled to a lockset chassis having a lever sleeve extending through a rose liner, the lever sleeve having a longitudinal axis, the mechanism comprising:

resilient means, rigidly attached to the lever sleeve, for releasably locking the lever to the sleeve, wherein the resilient means includes a band having a first button and a second button; and clip means, coupled to the sleeve, for preventing the resilient means from collapsing in a direction parallel to the longitudinal axis of the sleeve.

2. The mechanism of claim 1 wherein the clip means includes a C-shaped clip.

3. A spring detent mechanism for a reversible lever, the lever being coupled to a lockset chassis having a lever sleeve extending through a rose liner, the lever sleeve having a longitudinal axis, the mechanism comprising:

a resilient band attached to the sleeve and including a first button configured to engage the sleeve and a second button configured to engage the lever; and a C-shaped band coupled to the sleeve to prevent movement of the second button parallel to the longitudinal axis of the sleeve.

4. A spring detent mechanism for a reversible lever, the lever being coupled to a lockset chassis having a lever sleeve extending through a rose liner, the lever sleeve having a longitudinal axis, the mechanism comprising:

a cantilevered flat lever catch having a first end and a second end, the first end including a first button press fit into a hole formed in the sleeve and the second end including a second button for engaging the lever; and a clip disposed on the sleeve orthogonally to the lever catch to engage the second button to prevent movement of the lever along the longitudinal axis of the sleeve.

* * * * *